US008196574B2

(12) United States Patent
Ichikawa

(10) Patent No.: US 8,196,574 B2
(45) Date of Patent: Jun. 12, 2012

(54) NOSE MASK

(75) Inventor: Shinichi Ichikawa, Ashigarakami-gun (JP)

(73) Assignee: FUJIFILM Corporation, Tokyo (JP)

( * ) Notice: Subject to any disclaimer, the term of this patent is extended or adjusted under 35 U.S.C. 154(b) by 926 days.

(21) Appl. No.: 12/240,165

(22) Filed: Sep. 29, 2008

(65) Prior Publication Data

US 2009/0084378 A1 Apr. 2, 2009

(30) Foreign Application Priority Data

Sep. 28, 2007 (JP) ..... 2007-256148

(51) Int. Cl.
*A61D 7/04* (2006.01)

(52) U.S. Cl. ..... 128/203.12; 119/420

(58) Field of Classification Search ..... 128/200.24, 128/203.12, 203.13, 203.14, 203.15, 204.18, 128/204.23; 119/420
See application file for complete search history.

(56) References Cited

U.S. PATENT DOCUMENTS 4,332,244 A * 6/1982 Levy et al. ..... 128/205.25
4,520,808 A * 6/1985 LaBauve ..... 128/200.14
4,721,060 A * 1/1988 Cannon et al. ..... 119/420
4,860,741 A * 8/1989 Bernstein et al. ..... 128/204.18
5,297,502 A * 3/1994 Jaeger ..... 119/420
D474,270 S * 5/2003 Anderson ..... D24/110
6,651,587 B1 * 11/2003 DeFord et al. ..... 119/420
6,776,158 B1 * 8/2004 Anderson et al. ..... 128/203.12
7,377,276 B2 * 5/2008 Roy et al. ..... 128/203.14
7,503,323 B2 * 3/2009 Dalgetty et al. ..... 128/203.15

FOREIGN PATENT DOCUMENTS

JP 2005-517507 A 6/2005

* cited by examiner

*Primary Examiner* — Steven Douglas

(74) *Attorney, Agent, or Firm* — Sughrue Mion, PLLC

(57) ABSTRACT

A nose mask for applying an anesthesia gas to a laboratory animal in a casing means includes an anesthesia tube, an outer wall which is disposed outside the anesthesia tube to form a space therebetween and an anesthesia recovery system having an anesthesia recovery port open to the space. The anesthesia tube includes an anesthesia supply section which opens to an wall of the anesthesia tube so that the anesthesia is applied to the laboratory animal by inserting the nose of the laboratory animal, an anesthesia introducing section for introducing the anesthesia gas to the anesthesia tube, and an anesthesia discharging section for discharging the anesthesia gas from the anesthesia tube.

8 Claims, 7 Drawing Sheets

NOSE MASK

BACKGROUND OF THE INVENTION

1. Field of the Invention

This invention relates to a nose mask for applying an anesthesia gas to the laboratory animal.

2. Description of the Related Art

Recently, there has been in wide use a method called "in vivo imaging" where an in vivo action in a laboratory animal such as mouse is directly observed as it is alive. For example, after a diseased part such as tumor is created in the laboratory animal, and agents labeled by phosphors and the like is dosed in the laboratory animal through a blood vessel injection, collection or dispersion of the agents with time to and from the diseased part can be observed by projecting an exciting light onto the diseased part.

Further, there exists a method of chemiluminescence where a biological tissue is investigated (gene analysis, disease, aging) or an organic material or a polymer is evaluated using a reaction where light is emitted (chemiluminescence) with the reaction when materials react with each other. In this chemiluminescent method, the chemiluminescence is generated by bringing an organic material into contact with a chemiluminescent substrate after, for example, the organic material is labeled with antigen and an antibody labeled with a labeling material which generates the chemiluminescence when contacting to the chemiluminescent substrate is brought into contact with the antigen.

In the technic of the in vivo imaging, since the fluorescence or the chemiluminescence to be detected is very weak, the laboratory animal which is the object is housed in a casing light-shielding to external light and the fluorescence or the chemiluminescence discharged from the laboratory animal is detected by a cooled CCD. Specifically, in the method of the fluorescence, from an exciting light source provided in the casing, the exciting light is projected onto the laboratory animal and the fluorescence discharged from the laboratory animal is passed through a high-sensitive lens to image on the cooled CCD thereby visualizing the fluorescence. In the method of the chemiluminescence, the chemiluminescence discharged from the laboratory animal is passed through a high-sensitive lens to image on the cooled CCD with the exciting light source kept put off. In either of the method of the fluorescence and the method of the chemiluminescence, an unexpected recovery of the consciousness of the laboratory animal deteriorates the quality of the image taken and accordingly, an anesthesia is applied to the laboratory animal during the experiment. There is disclosed in PCT Japanese Publication No. 2005-517507, a system for applying an anesthesia where an anesthesia gas is mixed in a low-pressure oxygen gas to form an anesthesia gas by the use of a vaporizer and the anesthesia gas is supplied to a nose mask in the casing. The flow of the anesthesia gas at this time is controlled by an on-off valve and the flow of the anesthesia gas upon discharge is controlled by a vacuum pump.

In the technic of the in vivo imaging, it is necessary in order to prevent deterioration of the quality of the image taken due to a recovery of the consciousness of the laboratory animal that the laboratory animal in the casing during an image taking is applied with an anesthesia and accordingly, it is necessary to introduce and discharge the anesthesia gas into and from the nose mask in the casing. Introduction and discharge of the anesthesia gas into and from the nose mask in the casing can result in fear that the anesthesia gas leaked from the nose mask can remain in the casing. When the anesthesia gas remains in the casing can result in fear that the worker inspires the anesthesia gas when taking out the laboratory animal upon end of the image taking.

In the technic disclosed in PCT Japanese Publication No. 2005-517507, when the flow of the anesthesia gas upon discharge is increased by a vacuum pump, thereby reducing the anesthesia gas leaked from the nose mask, it becomes difficult to apply a sufficient anesthesia to the laboratory animal. On the other hand, when the flow of the anesthesia gas controlled by an on-off valve to increase the flow of the supply side, thereby applying a sufficient anesthesia to the laboratory animal, it becomes difficult to prevent the anesthesia gas leaked from the nose mask from remaining in the casing.

SUMMARY OF THE INVENTION

In view of the foregoing observations and description, the primary object of the present invention is to provide a nose mask which can prevent the anesthesia gas leaked from the nose mask from remaining in the casing and can apply a sufficient anesthesia to the laboratory animal.

In accordance with the present invention, there is provided a nose mask for applying an anesthesia gas to a laboratory animal in a casing comprising an anesthesia tube and an anesthesia recovery system having an outer wall which is disposed outside the anesthesia tube to form a space therebetween and an anesthesia recovery port open to the space, wherein the anesthesia tube comprises an anesthesia supply section which opens to an wall of the anesthesia tube so that the anesthesia is applied to the laboratory animal by inserting the nose of the laboratory animal, an anesthesia introducing section for introducing the anesthesia gas to the anesthesia tube, and an anesthesia discharging section for discharging the anesthesia gas from the anesthesia tube.

The "anesthesia gas" means a vaporized anesthesia source mixed with a carrier gas supplied to the laboratory animal. The "anesthesia tube" means a hollow structure filled therein an anesthesia gas. "To recover the anesthesia gas" described above means to recover the anesthesia gas leaked from the anesthesia tube to the casing. "To insert the nose of the laboratory animal" described above means to insert the nose of the laboratory animal so that the laboratory animal inspires the anesthesia gas and it is unnecessary to insert the whole of the nose of the laboratory animal. "To introduce the anesthesia gas" described above means to supply the anesthesia gas to the anesthesia tube for a predetermined time so that the housed laboratory animal is continuously kept applied with an anesthesia. "To discharge the anesthesia gas" described above means to discharge the anesthesia gas remaining in the anesthesia tube unused to the laboratory animal by introducing the anesthesia gas into the anesthesia tube.

In the nose mask, the anesthesia supply section maybe changed in its shape of opening according to the shape of the nose of the laboratory animal.

Here, the "shape of the nose of the laboratory animal" means the shape of the nose of the laboratory animal at the part to be inserted into the anesthesia supply section.

In the nose mask, the anesthesia supply section may comprise a plurality of the openings different in size.

In the nose mask, the anesthesia supply section may be movable according to the posture of the laboratory animal when the anesthesia is applied.

The anesthesia supply section and the anesthesia discharging section may be connected to the anesthesia tube by extending through the outer wall.

The outer wall may be channel-shaped in cross-section surrounding the anesthesia tube.

In accordance with the nose mask of the present invention, the nose mask comprises the anesthesia tube having an anesthesia supply section which opens to an wall of the anesthesia tube so that the anesthesia is applied to the laboratory animal by inserting the nose of the laboratory animal, and the outer wall which is disposed outside the anesthesia tube to form a space therebetween and the anesthesia recovery system having a recovery port opening the space. Accordingly the laboratory animal can be sufficiently applied with the anesthesia gas from the anesthesia tube and the anesthesia gas which is leaked from the nose mask and remains in the casing can be reduced by recovering the anesthesia gas through the recovery port opening the space between the anesthesia tube and the outer wall.

DESCRIPTION OF THE PREFERRED EMBODIMENT

Figure 1:
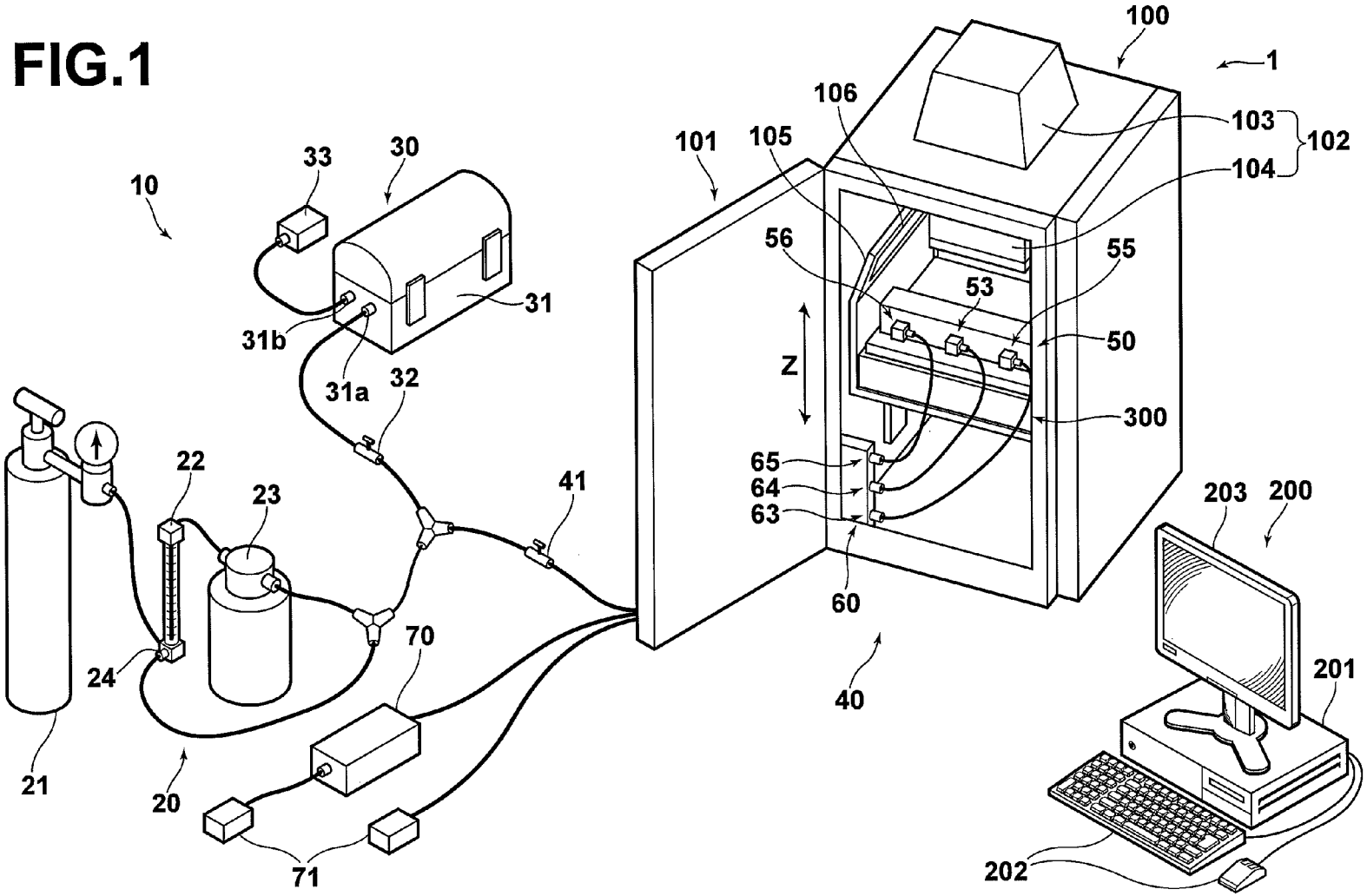
FIG. 1 is a view showing an image taking system 1 employing the present invention.

Embodiments of a nose mask 50 of the present invention will be described with reference to the drawings, hereinbelow. FIG. 1 is a view showing an image taking system 1 employing the nose mask 50 of the present invention. The image taking system 1 of FIG. 1 comprises a casing means 101 for taking an image of fluorescent light or chemiluminescence generated from a laboratory animal R, an image taking means 102, a control means 200, an incubator means 300 and an anesthesia system 10.

The casing means 101 has a rectangular hollow portion in which a laboratory animal R is housed. The casing means 101 has a lid which is mounted to the casing means 101 to be opened so that the user can takes in and out the laboratory animal R. The casing means 101 comprises a housing 105 disposed therein and a light source 106 above the housing 105.

The housing 105 is movable up and down (in the direction of Z in FIG. 1) in the casing means 101 by a drive section (not shown). The light source 106 is for projecting exciting light onto the laboratory animal and comprises, for instance, a number of two dimensionally arranged LEDs. A plurality of light sources 106 different in wavelength are prepared so that one of the wavelengths can be suitably selected according to the wavelength of the fluorescence label and the light source 106 itself is changeable. LEDs emitting light at a plurality of wavelengths may be alternately provided for one light source 106 so that the light source 106 emits light at a desired wavelength by only LEDs, or the light source 106 may comprise a combination of a white light source such as a halogen lamp or a white LED and a plurality of spectroscopic filters so that the wavelength band of the exciting light is switched by suitably changing the spectroscopic filters.

The image taking means 102 comprises an image taking section 103 which is formed of, for instance, a plurality of two dimensionally arranged LEDs and takes an image of fluorescent light or chemiluminescence generated from a laboratory animal R to output it as an image information, and a lens section 104 which images an image on the image taking face of the image taking elements. The image taking section 103 is fixed to the upper surface of the casing means 101. To the image taking section 103, is mounted a cooler (not shown), and an image information can be suppressed from including noise components due to a dark current by cooling the image taking means 102.

The lens section 104 is formed by a combination of a plurality of lenses and has a function of automatically making the laboratory animal R in focus. Further, the lens section 104 is provided with an exciting light cut filter (not shown), so that the exciting light reflected by the laboratory animal R does not impinge upon the image taking section 103.

The control means 200 controls an image taking system 100, and is formed by a processing section 201, an input section 202 such as a mouse, keyboard or the like, and a display section 203 comprising a CRT, a liquid crystal display or the like to control the image taking means 102. The control means 200 obtains the image information and displays an image on the display section 203 on the basis of the image information.

Further, the control means 200 controls a drive section (not shown) from a position information of the housing 105 to control the up and down (in the direction of Z in FIG. 1) movement of the housing 105.

The incubator means 300 is fixed to the housing 105 and controls the temperature and humidity in the space surrounding the laboratory animal R in the casing 101 to the predetermined state. That is, the incubator means 300 can keep the temperature and humidity in the space surrounding the laboratory animal R to 37° C., 95% RH. Further, in order to keep the temperature and humidity in the space surrounding the laboratory animal R to the same as the environment in the biology, it is preferred that the temperature and humidity in the space surrounding the laboratory animal R be controlled to 36-37° C., 80-95% RH. The incubator means 300 will be described in detail later.

The anesthesia system 10 comprises an anesthesia gas generating system 20 for generating an anesthesia gas G, an anesthesia gas introduction system 30 for applying an anesthesia gas G to a laboratory animal R before the laboratory animal is housed in the casing means 101, and an anesthesia gas supply system 40 for supplying an anesthesia gas G to a laboratory animal R in the casing means 101.

The anesthesia gas generating system 20 generates an anesthesia gas G by mixing a vaporized anesthesia source in a carrier gas, and comprises a bombe 21 for supplying a carrier gas, a flow meter 22 for monitoring the flow rate of the carrier gas to be mixed, a vaporizer 23 which generates an anesthesia gas G by mixing a vaporized anesthesia source in a carrier gas and a flush valve 24 mounted between the high-pressure bombe 21 and the flow meter 22. Specifically, oxygen gas, nitrogen gas, or carbon dioxide gas is used and further, even pressurized air may be used by using a compressor in place of the bombe 21. As the specific anesthesia source, isoflurane is used. When the flush valve 24 is opened, the carrier gas is supplied to the anesthesia gas introduction system 30 and the anesthesia gas supply system 40 without via the vaporizer 23, that is, as it is a carrier gas. As the specific vaporizer 23, it is preferred to use those made by VetEquip, Inc., MUROMACHI KIKAI CO., LTD. or NATSUME SEISAKUSHO CO., LTD.

The anesthesia gas introduction system 30 fills the laboratory animal R with the anesthesia gas before the laboratory animal is housed in the casing means 101, and comprises an introduction chamber 31 for housing the laboratory animal. The introduction chamber 31 comprises a chamber introduction port 31*a* through which the anesthesia gas G is supplied from the anesthesia gas generating system 20, a chamber discharge port 31*b* through which the anesthesia gas G is discharged from the introduction chamber 31, and a chamber recovery port 31*c* which is used when pressurized air is used as the carrier gas. Supply to the chamber introduction port 31*a* is controlled by chamber introduction valve 32 and the anesthesia gas G recovered through the chamber discharge port 31*b* is released to the atmosphere by way of the chamber filter. The anesthesia gas supply system 40 comprises a nose mask 50 disposed in a sample tray 302 of the incubator means 300 to be described later, a ventilation block 60 which is disposed on a side surface of the casing means 101 and used in introduction, recovery and discharge of the anesthesia gas G into and from the nose mask 50 and outside the casing means 101, and a negative pressure source 70 which inspires the anesthesia gas G to be recovered. Further, the anesthesia gas G recovered or discharged is released to the atmosphere by way of the filter 71.

The nose mask 50 comprises an anesthesia introducing section 55 into which the anesthesia gas G is introduced, an anesthesia recovery section 53 which recovers the leaked anesthesia gas, an anesthesia discharging section 56 for discharging the anesthesia gas G and an anesthesia supply section 54 which supplies the anesthesia gas G to the laboratory animal.

The ventilation block 60 comprises a ventilation introducing section 63 through which the anesthesia gas G is introduced into the nose mask 50 from outside the casing means 101, a ventilation recovery section 64 which discharges outside the casing means 101 the recovered leaked anesthesia gas, and a ventilation discharging section 65 for discharging the discharged anesthesia gas G outside the casing means 101.

Figure 2A:
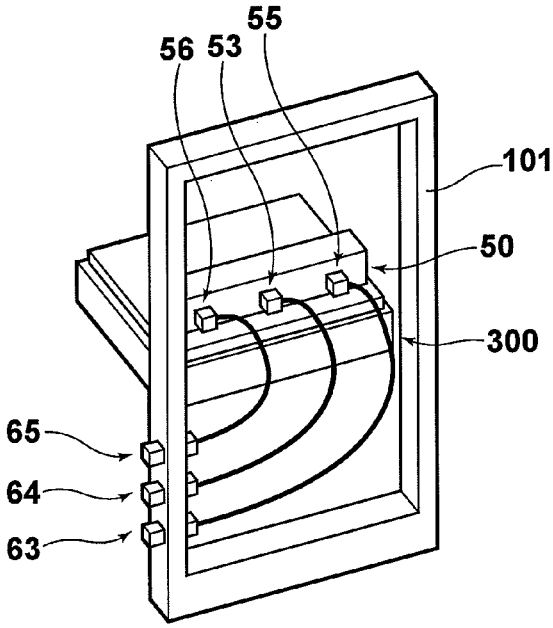
FIG. 2A is a rear view showing a piping between the ventilation block and the nose mask of the present invention with a part of the casing abbreviated for the purpose of simplicity of the understanding.
Figure 2B:
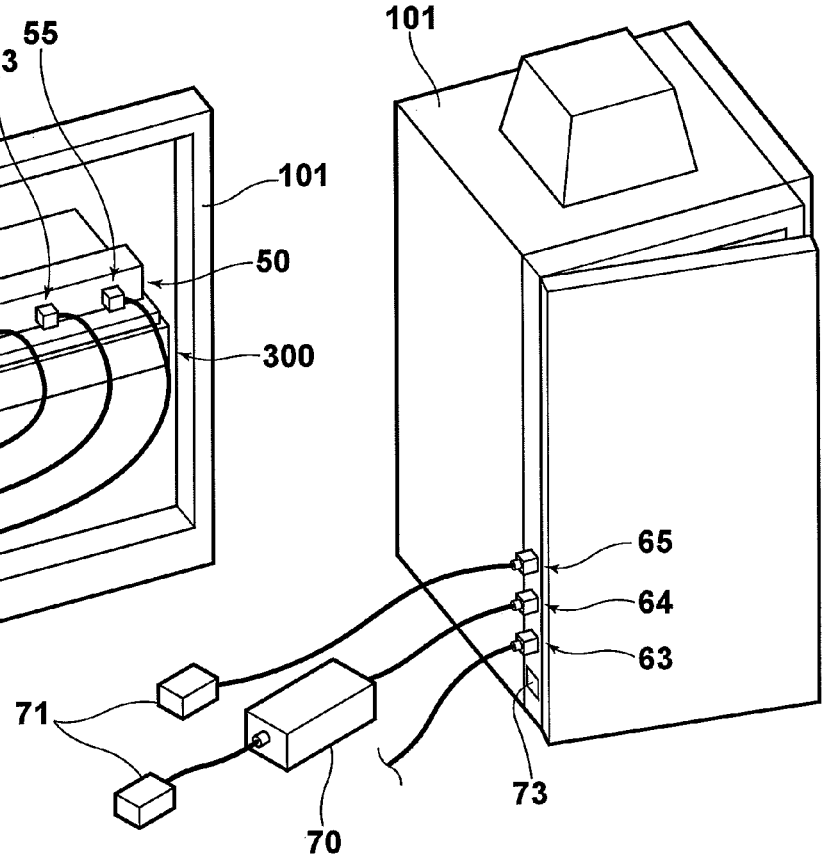
FIG. 2B is a side view showing a piping between the ventilation block and the nose mask of the present invention.

The piping between outside the casing means 101 and the nose mask 50 will be described, hereinbelow. FIG. 2A is a rear view showing a piping between the ventilation block and the nose mask of the present invention with a part of the casing abbreviated for the purpose of simplicity of the understanding, and FIG. 2B is a side view showing a piping between the ventilation block and the nose mask of the present invention. As shown in FIG. 2A, the anesthesia introducing section 55 and the ventilation introducing section 63, the anesthesia recovery section 53 and the ventilation recovery section 64, and the anesthesia discharging section 56 and the ventilation discharging section 65 are respectively connected to each other in the casing means 101.

As shown in FIG. 2B, outside the casing means 101, the ventilation introducing section 63 and the anesthesia generating system 20 (not shown), the ventilation recovery section 64 and the negative pressure source 70, and the ventilation discharging section 65 and the filter 71 are respectively connected to each other. Further, the anesthesia gas G leaked into the casing means 101 may be discharged outside the casing means 101 by providing a second anesthesia recovery port 73 in the casing means 101.

Figure 3A:
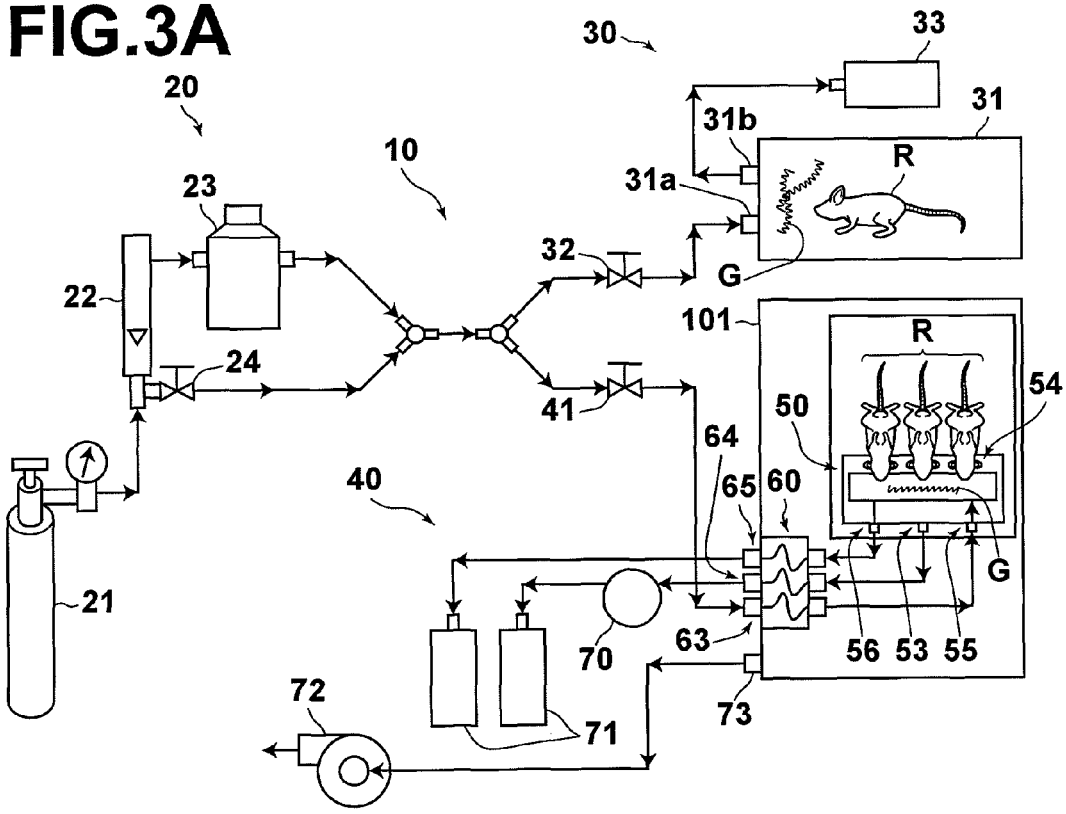
FIG. 3A is a view showing a piping of the image taking system 1 employing the present invention when oxygen gas is employed as the carrier gas.
Figure 3B:
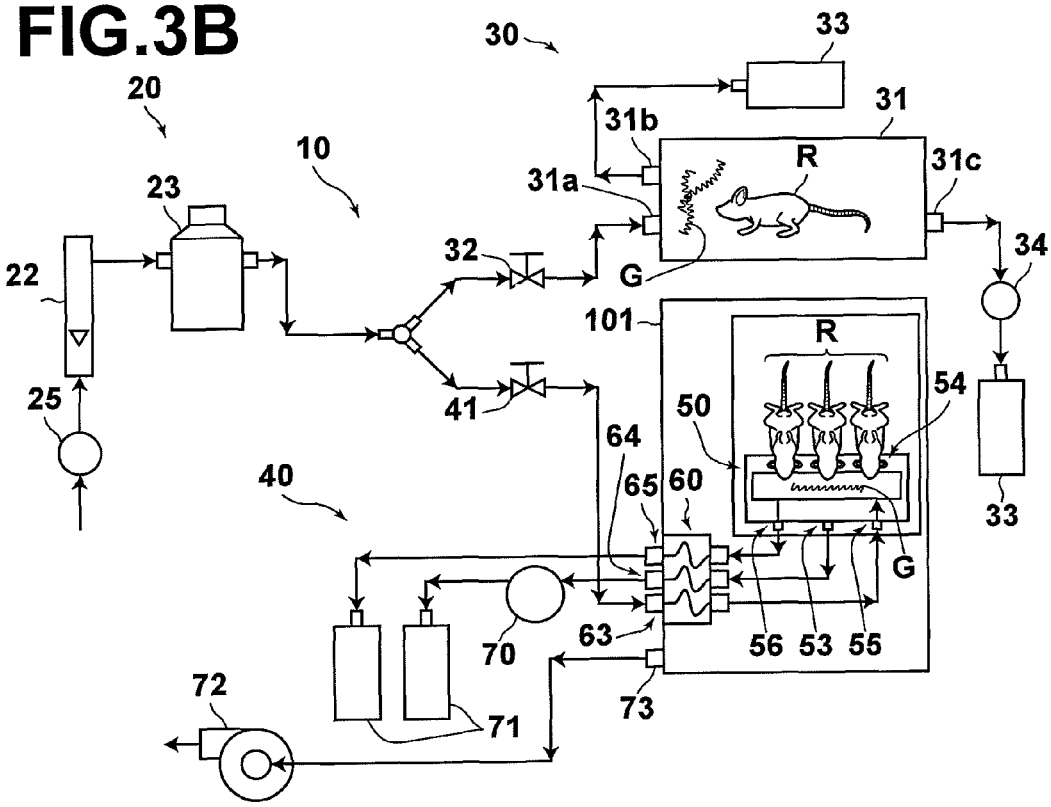
FIG. 3B is a view showing a piping of the image taking system 1 employing the present invention when air is employed through a compressor as the carrier gas.

A method of applying the anesthesia by the use of the anesthesia system 10 will be described, hereinbelow. FIG. 3A is a view showing a piping of the anesthesia system 10 of the image taking system 1 employing the present invention when oxygen gas is employed as the carrier gas, while FIG. 3B is a view showing a piping of the anesthesia system 10 of the image taking system 1 employing the present invention when air is employed through a compressor as the carrier gas.

Description will be made here on the basis of mainly FIG. 3A.

Oxygen gas whose flow rate is monitored by the flow meter 22 is supplied to the vaporizer 23 from the bombe 21. In the vaporizer 23, anesthesia gas G is generated by mixing the oxygen gas in the vaporized anesthesia source. In this embodiment, for instance, isoflurane is used as the anesthesia source.

The operator houses the laboratory animal R in the introduction chamber 31 with the introduction valve 32 closed. When the operator opens the introduction valve 32, the anesthesia gas G is introduced into the introduction chamber 31 through the chamber introduction port 31*a*. By the introduced anesthesia gas G, the anesthesia is applied to the housed laboratory animal R and at the same time, the anesthesia gas G in the introduction chamber 31 is discharged through the chamber discharge port 31*b*. The discharged anesthesia gas G is released to atmosphere by way of the chamber filter 33.

After the anesthesia is sufficiently applied to the laboratory animal R, the operator opens the flush valve 24 to introduce only the oxygen gas to the introduction chamber 31 from the chamber discharge port 31*b* without via the vaporizer 23. The introduced oxygen gas purges all the anesthesia gas G in the introduction chamber 31 through the chamber discharge port 31*b*. Subsequently, the operator takes out the laboratory animal R from the casing means 101, and closes the flush valve 24 and the introduction valve 32.

In the case of FIG. 3B, that is, when air is used as the carrier gas by way of a compressor 25, since the anesthesia gas generating system 20 has no flush valve, the introduction chamber 31 is provided with a chamber recovery port 31*c* and the chamber recovery port 31*c* is connected to the chamber negative pressure source 34 so that the anesthesia gas G in the introduction chamber 31 is recovered through the chamber recovery port 31*c*. That is, the operator, after he or she closes the introduction valve 32, operates the chamber negative pressure source 34 to inspire the anesthesia gas G in the introduction chamber 31, whereby the anesthesia gas G in the introduction chamber 31 is discharged through the chamber recovery port 31*c*. The discharged anesthesia gas G is released to atmosphere by way of the chamber filter 33.

With this arrangement, less anesthesia gas G remains in the introduction chamber 31 and there is a less fear that operator inspires the anesthesia gas G, whereby the laboratory animal R can be taken out from the introduction chamber 31 with safety.

The operator houses the laboratory animal R which has been applied with the anesthesia by such an anesthesia introduction system 30 in the casing means 101 with the supply valve 41 closed. The operator inserts the nose of the laboratory animal R into the anesthesia supply section 54 of the nose mask 50 and when the operator opens the supply valve 41, the anesthesia gas G is supplied to the anesthesia supply section 54 from the ventilation introducing section 63. The laboratory animal R is applied with the anesthesia by the anesthesia gas G. By supplying the anesthesia gas G, the anesthesia gas G is purged and discharged by the ventilation discharging section 65. From the ventilation discharging section 65, the anesthesia gas G is discharged outside the casing means 101 and released to atmosphere byway of the filter 71. When the negative pressure source 70 inspires, the anesthesia gas G leaked in the casing means 101 from the nose mask 50 is purged and discharged to the ventilation recovery section 64 from the anesthesia recovery section 53 and released to atmosphere by way of the filter 71.

When taking an image is ended, the operator takes out the housed laboratory animal R after the anesthesia gas G leaked in the casing means 101 is sufficiently inspired by the negative pressure source 70. In FIGS. 3A and 3B, the casing means 101 is provided with a second recovery port 73 and further inspired by a second negative pressure source 73, whereby the anesthesia gas G leaked in the casing means 101 is prevented from remaining in the casing means 101.

Accordingly, less anesthesia gas G remains in the introduction chamber 31 and there is a less fear that operator inspires the anesthesia gas G, whereby the laboratory animal R can be taken out from the casing means 101 with safety.

Figure 4A:
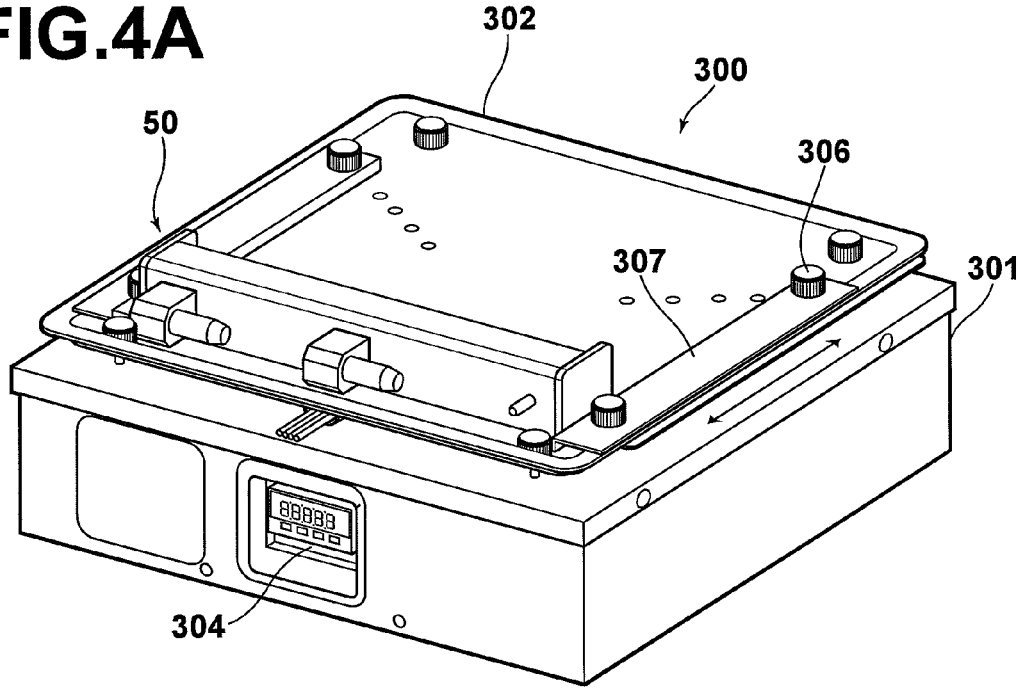
FIG. 4A is a perspective view showing the incubator means as viewed from front.

The incubator means 300 will be described, hereinbelow. FIG. 4A is a perspective view showing the incubator means 300 as viewed from front, while FIG. 4B is a perspective view showing the incubator means 300 with a body portion 301 to be described later abbreviated for the purpose of simplicity of understanding.

Figure 4B:
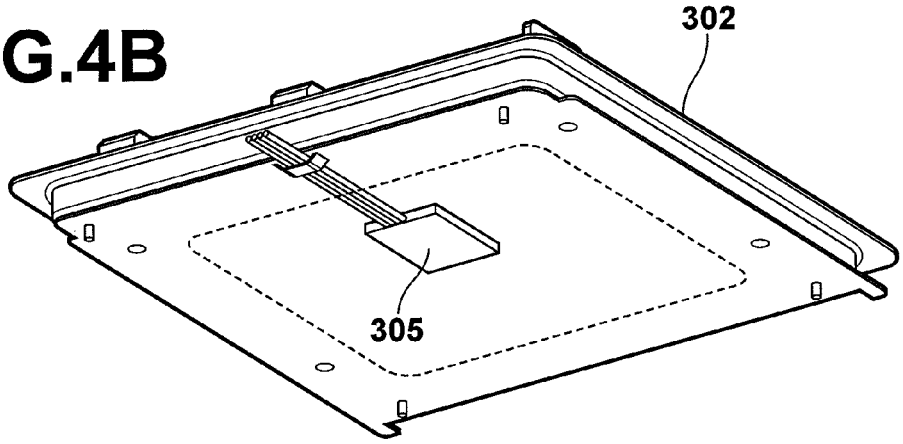
FIG. 4B is a perspective view showing the incubator means with a body portion abbreviated for the purpose of simplicity of understanding.

The incubator means 300 controls the space surrounding the laboratory animal R in the casing means 101 to a predetermined temperature as described above, and comprises, as shown in FIG. 4A, the body portion 301, a sample tray 302 which is disposed on the body portion 301 and on which the laboratory animal R is placed, a heater 303 disposed between the body portion 301 and the sample tray 302, a controller 304 built in the body portion 301, and a temperature sensor 305 which is disposed on the backside of the sample tray 302 to monitor the temperature as shown in FIG. 4B. As shown in FIG. 4A, the sample tray 302 is provided with a guide 307 fixed with bolts 306 to freely support (in the direction of the arrows in FIG. 4A) the nose mask 50.

The nose mask 50 of the present invention will be described, hereinbelow.

Figure 5A:
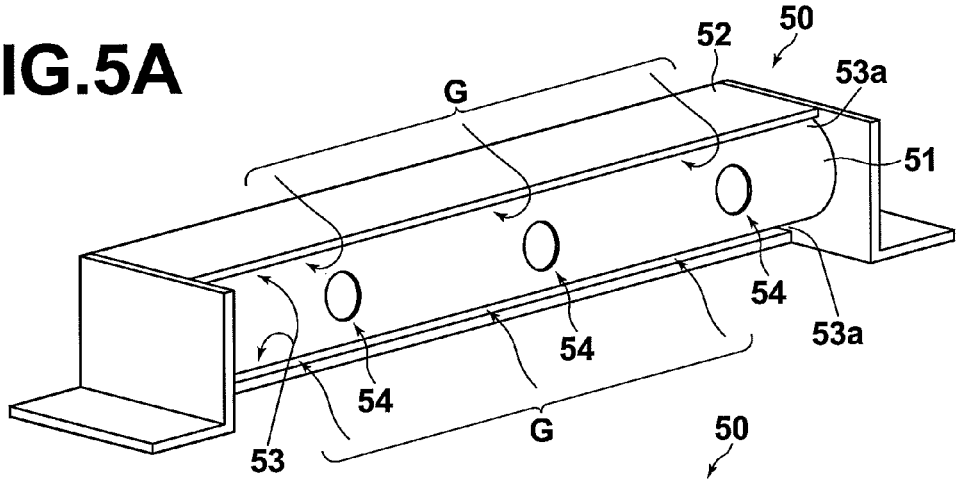
FIG. 5A is a perspective view showing the nose mask as viewed from front.

FIG. 5A is a perspective view showing the nose mask 50 as viewed from front. As shown in FIG. 5A, the nose mask 50 comprises the anesthesia tube 51 and the anesthesia recovery system 53 having an outer wall 52 which is disposed outside the anesthesia tube 51 to form a space therebetween and an anesthesia recovery port 53*a* open to the space between the anesthesia tube 51 and the outer wall 52 to recover the anesthesia gas G.

Figure 5B:
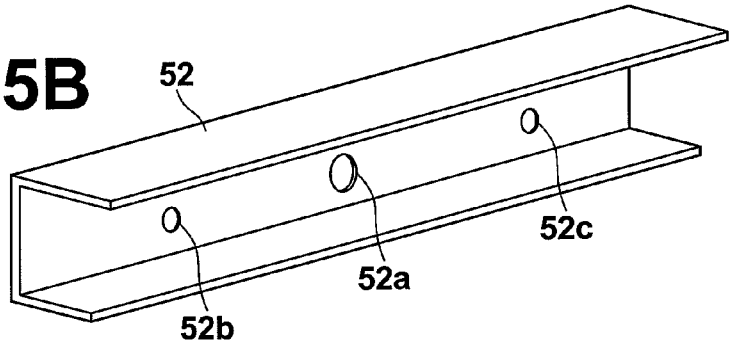
FIG. 5B is a perspective view showing the nose mask as viewed from front with the anesthesia tube abbreviated for the purpose of simplicity of understanding.

FIG. 5B is a perspective view showing the nose mask as viewed from front with the anesthesia tube 51 abbreviated for the purpose of simplicity of understanding. As shown in FIG. 5B, the outer wall 52 has, for instance, a channel-shaped cross-section so that the space is formed by surrounding a part of the anesthesia tube 51. Further, in this embodiment, the anesthesia gas G recovered through the anesthesia recovery port 53*a* is recovered through a recovery through-hole 52*a* passing through the space between the anesthesia tube 51 and the outer wall 52.

Figure 5C:
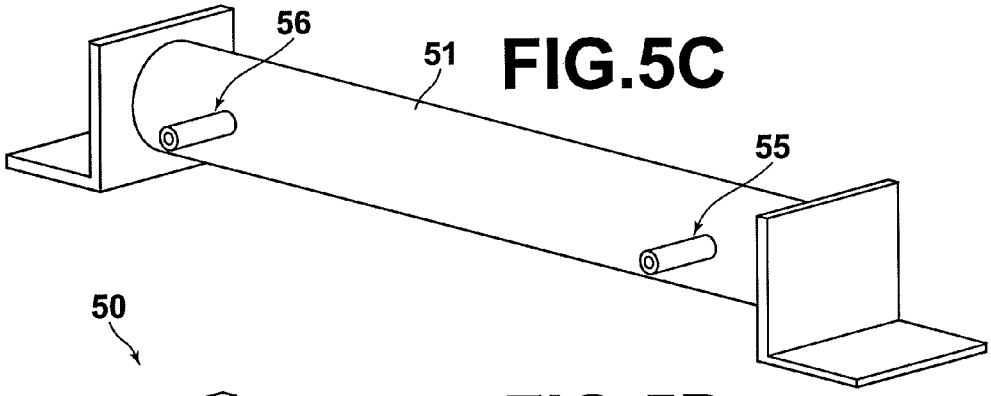
FIG. 5C is a perspective view showing the nose mask as viewed from rear with the outer wall abbreviated for the purpose of simplicity of understanding.

FIG. 5C is a perspective view showing the nose mask 50 as viewed from rear with the outer wall 52 abbreviated for the purpose of simplicity of understanding. As shown in FIG. 5C, the anesthesia tube 51 comprises an anesthesia introducing section 55 into which the anesthesia gas G is introduced and an anesthesia discharging section 56 for discharging the anesthesia gas G from the anesthesia tube 51.

Referring again to FIG. 5B, by providing the outer wall 52 with the anesthesia introducing through-hole 52*b* and anesthesia discharging through-hole 52*c*, the anesthesia gas G can be introduced into and discharged from the anesthesia tube 51 through the outer wall 52.

Figure 5D:
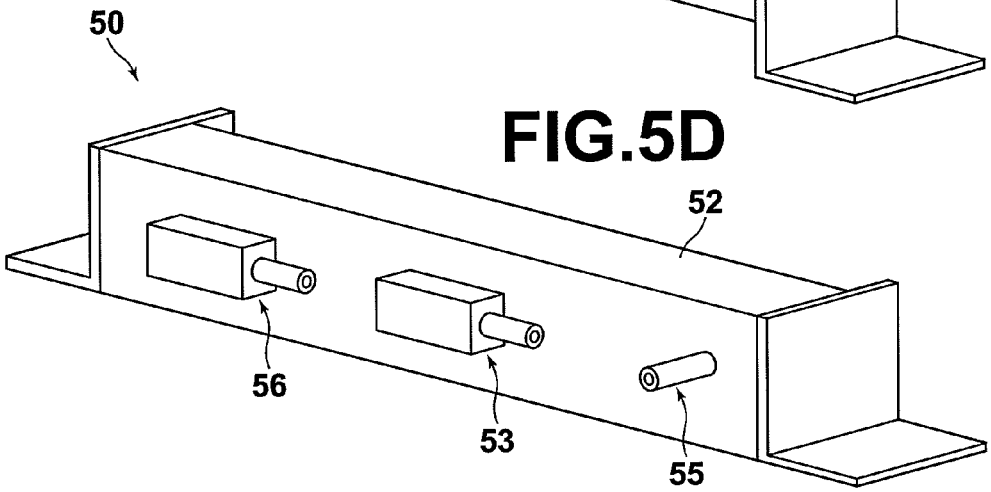
FIG. 5D is a perspective view showing the nose mask as viewed from rear.

FIG. 5D is a perspective view showing the nose mask as viewed from rear. As shown in FIG. 5D, in this embodiment, the anesthesia introducing section 55 and the anesthesia discharging section 56 are communicated and connected with each other through the outer wall 52.

Figure 6A:
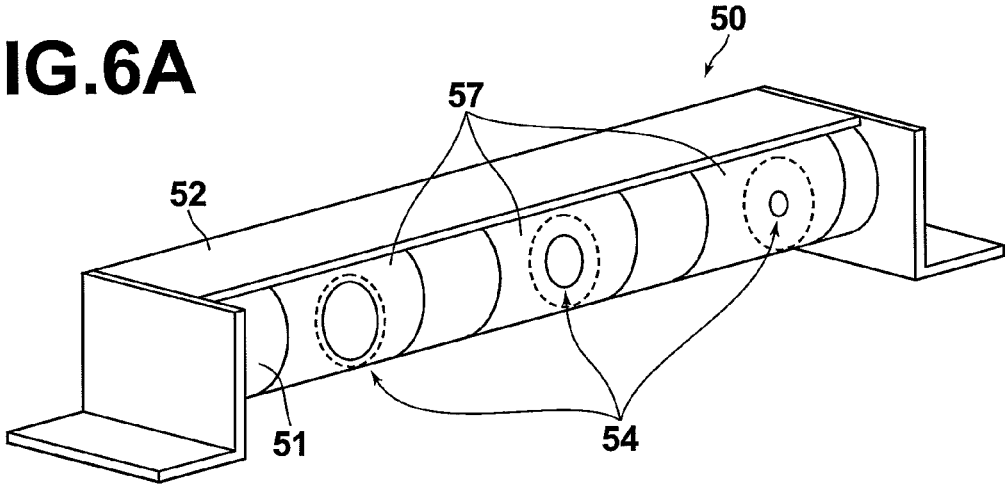
FIG. 6A is a perspective view showing the anesthesia supply section in accordance with a first embodiment of the present invention.
Figure 6B:
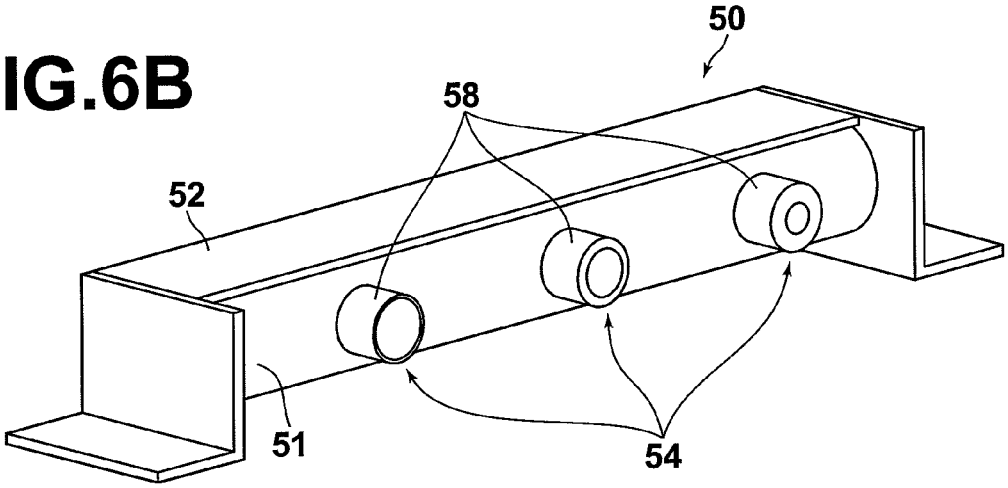
FIG. 6B is a perspective view showing the anesthesia supply section in accordance with a second embodiment of the present invention.
Figure 6C:
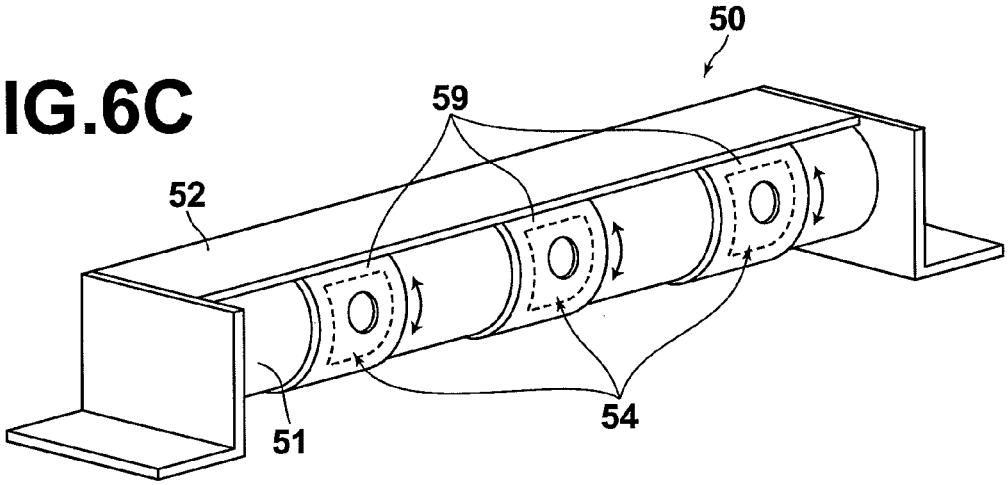
FIG. 6C is a perspective view showing the anesthesia supply section in accordance with a third embodiment of the present invention.

Embodiments of the anesthesia supply section 54 of the present invention will be described, hereinbelow. FIGS. 6A to 6C are perspective views showing embodiments of the anesthesia supply section 54 of the present invention.

FIG. 6A is a view showing an anesthesia supply section 54 formed by bonding resilient silicone rubber sheets 57 connected to openings in the wall of the anesthesia tube 51 shown by the dotted lines in FIGS. 6A to 6C and having an opening. The size of the opening of the silicone rubber sheets 57 may be changed according to the shape of the nose of the laboratory animal R. Further, the resiliency of the silicone rubber sheets 57 increases the close contact between the nose of the laboratory animal R and the opening of the silicone rubber sheets 57, whereby the anesthesia gas G can be made difficult to leak from the nose mask 50.

FIG. 6B is a view showing an anesthesia supply section 54 formed by inserting changeable supply pipes 58 connected to openings (not shown) in the wall of the anesthesia tube 51 and having an opening. A plurality of the changeable supply pipes 58 different in size of the opening may be provided so that the size of the opening can be changed according to the shape of the nose of the laboratory animal R.

FIG. 6C is a view showing an anesthesia supply section 54 formed by mounting demountable supply rings 59 connected to elongated openings shown by the dotted lines in FIG. 6C in the wall of the movable anesthesia tube 51 (movable in the direction of the arrows in FIG. 6C) and having an opening. A plurality of the supply rings 59 different in size of the opening may be mounted so that the size of the opening can be changed according to the shape of the nose of the laboratory animal R. Further, since the supply rings 59 are movable with respect to the anesthesia tube 51, the position of the opening is changed according to the posture of the laboratory animal R when the anesthesia is supplied. When the opening of the supply rings 59 is smaller than the elongated openings in the anesthesia tube 51, the opening of the supply rings 59 can be communicated with the anesthesia tube 51.

Figure 7:
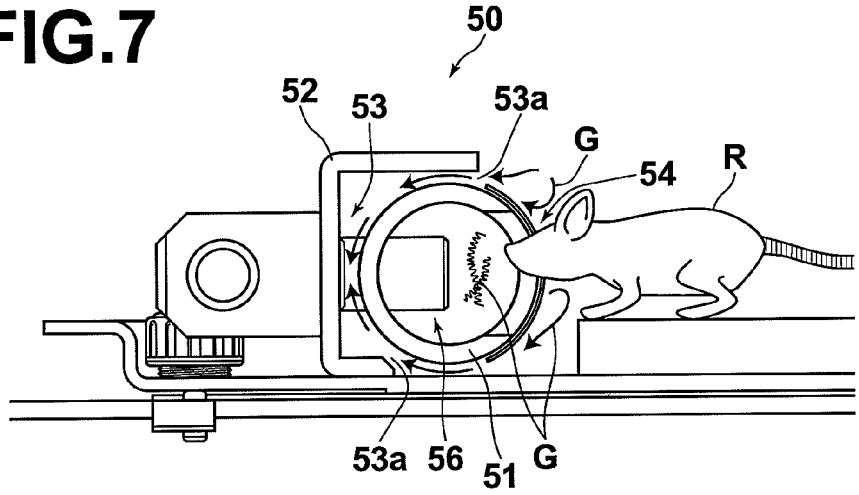
FIG. 7 is a view showing operation of the present invention.

Operation of the present invention will be described, hereinbelow. FIG. 7 is a view showing operation of the present invention. FIG. 7 shows a cross-section of the nose mask for the purpose of simplicity of the understanding. As shown in FIG. 7, the laboratory animal R inspires the anesthesia gas G in the anesthesia tube 51 introduced from the anesthesia introduction section 55 when the nose of the laboratory animal R is inserted into the anesthesia supply section 54, whereby the anesthesia is applied to the laboratory animal R. As described above, since the anesthesia discharging section 56 is not connected to the negative pressure source in this embodiment, the anesthesia gas G is constantly filled in the anesthesia tube 51. Further, the anesthesia gas G leaked from the anesthesia supply section 5 into the casing means 101 is recovered by the anesthesia recovery system 53 connected to the negative pressure source (not shown) through the recovery port 53*a* in the space between the negative pressure source anesthesia tube 51.

Accordingly, the laboratory animal R is applied to the anesthesia with sufficient anesthesia gas G in the anesthesia tube 51 and since the anesthesia gas G leaked in the casing means 101 is recovered by the anesthesia recovery system 53, the anesthesia gas G is prevented from remaining in the casing means 101.

Figure 8:
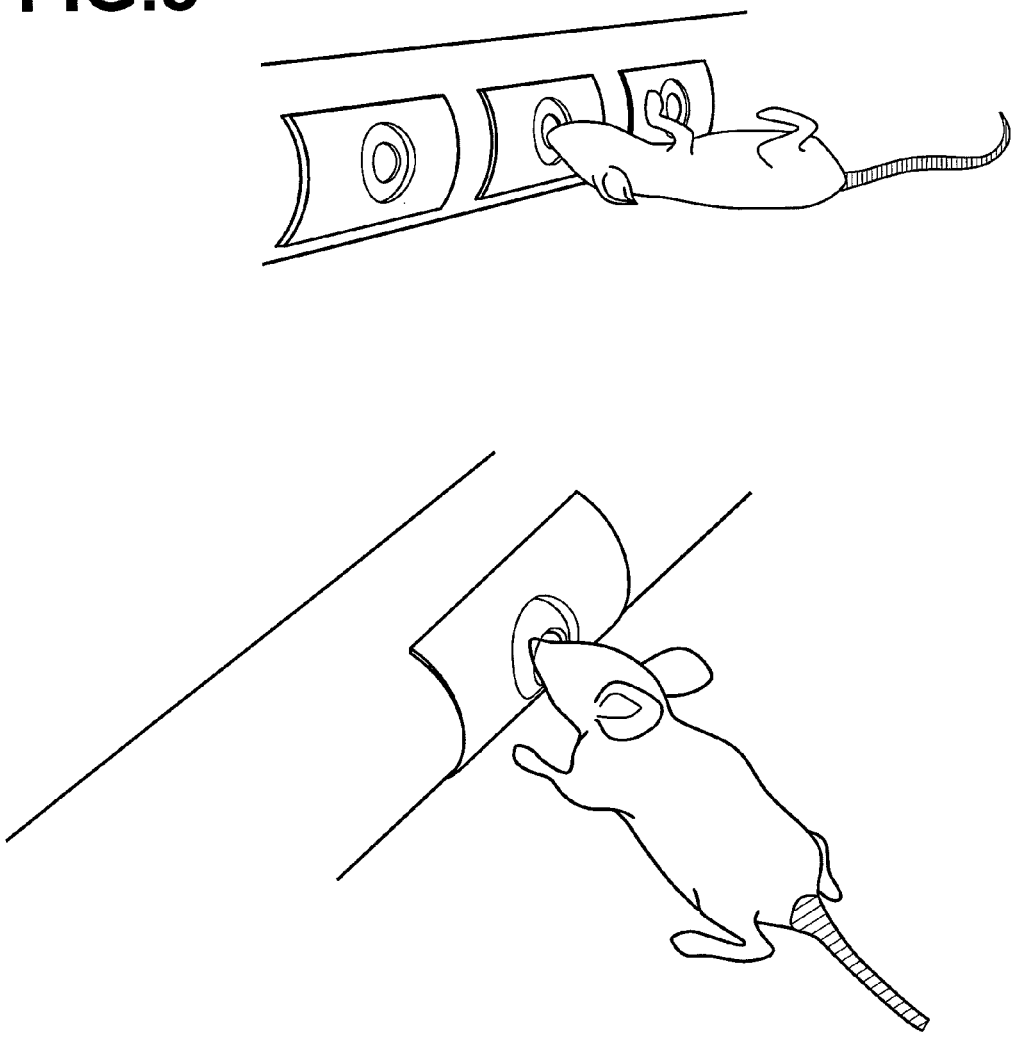
FIG. 8 is a view showing applying the anesthesia to the laboratory animal by the use of the nose mask of the present invention.

FIG. 8 is a view showing applying the anesthesia to the laboratory animal R by the use of the nose mask 50 of the present invention.

What is claimed is:

1. A nose mask for applying an anesthesia gas to a laboratory animal in a casing comprising:

an anesthesia tube, an outer wall which is disposed outside the anesthesia tube to form a space therebetween, and an anesthesia recovery system having an anesthesia recovery port open to the space, wherein the anesthesia tube comprises an anesthesia supply section which opens to an wall of the anesthesia tube so that the anesthesia is applied to the laboratory animal by inserting the nose of the laboratory animal, an anesthesia introducing section for introducing the anesthesia gas to the anesthesia tube, and an anesthesia discharging section for discharging the anesthesia gas from the anesthesia tube;

wherein the anesthesia supply section is changed in its shape of opening according to the shape of the nose of the laboratory animal.

2. A nose mask as defined in claim 1 in which the anesthesia supply section comprises a plurality of the openings different in size.

3. A nose mask for applying an anesthesia gas to a laboratory animal in a casing comprising:

an anesthesia tube, an outer wall which is disposed outside the anesthesia tube to form a space therebetween, and an anesthesia recovery system having an anesthesia recovery port open to the space, wherein the anesthesia tube comprises an anesthesia supply section which opens to an wall of the anesthesia tube so that the anesthesia is applied to the laboratory animal by inserting the nose of the laboratory animal, an anesthesia introducing section for introducing the anesthesia gas to the anesthesia tube, and an anesthesia discharging section for discharging the anesthesia gas from the anesthesia tube;

wherein the anesthesia supply section can be movable according to the posture of the laboratory animal when the anesthesia is applied.

4. A nose mask as defined in claim 1 in which the anesthesia supply section and the anesthesia discharging section are connected to the anesthesia tube by extending through the outer wall.

5. A nose mask as defined in claim 1 which the outer wall is channel-shaped in cross-section surrounding the anesthesia tube.

6. A nose mask as defined in claim 3 in which the anesthesia supply section comprises a plurality of the openings different in size.

7. A nose mask as defined in claim 3 in which the anesthesia supply section and the anesthesia discharging section are connected to the anesthesia tube by extending through the outer wall.

8. A nose mask as defined in claim 3 in which the outer wall is channel-shaped in cross-section surrounding the anesthesia tube.

* * * * *